US006239548B1

(12) United States Patent
Raina et al.

(10) Patent No.: US 6,239,548 B1
(45) Date of Patent: May 29, 2001

(54) MICROELECTRONIC SUBSTRATE ASSEMBLIES HAVING ELEMENTS IN LOW COMPRESSION STATE

(75) Inventors: Kanwal K. Raina; James J. Alwan, both of Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 09/643,202

(22) Filed: Aug. 21, 2000

Related U.S. Application Data

(62) Division of application No. 09/146,056, filed on Sep. 2, 1998, now Pat. No. 6,106,351.

(51) Int. Cl.[7] ..... H01J 1/62
(52) U.S. Cl. ..... 313/495; 313/309
(58) Field of Search ..... 313/495, 309, 313/336, 351, 461

(56) References Cited

U.S. PATENT DOCUMENTS 4,873,162 10/1989 Yoshioka et al. ..... 430/5
5,905,005 5/1999 Yabe et al. ..... 430/5
5,999,236 12/1999 Nakajima et al. ..... 257/59

*Primary Examiner*—Vip Patel
(74) *Attorney, Agent, or Firm*—Dorsey & Whitney LLP

(57) ABSTRACT

The present disclosure describes microelectronic substrate assemblies, and methods for making and using such substrate assemblies in mechanical and chemical-mechanical planarizing processes. A microelectronic substrate assembly is fabricated in accordance with one aspect of the invention by forming a critical layer in a film stack on the substrate and manipulating the critical layer to have a low compression internal stress. The critical layer, more specifically, is a layer that is otherwise in a tensile state or a high compression state without being manipulated to control the internal stress in the critical layer to be in a low compression state. The stress in the critical layer can be manipulated by changing the chemistry, temperature or energy level of the process used to deposit or otherwise form the critical layer. The stress in the critical layer can also be manipulated using heat treatments and other processes. A critical layer composed of chromium, for example, can be manipulated by sputtering chromium in an argon/nitrogen atmosphere instead of solely an argon atmosphere to impart stress controlling elements (nitrogen molecules) into the chromium for producing a low compression chromium layer.

7 Claims, 4 Drawing Sheets

MICROELECTRONIC SUBSTRATE ASSEMBLIES HAVING ELEMENTS IN LOW COMPRESSION STATE

CROSS-REFERENCE TO RELATED APPLICATION

This application is a divisional of pending U.S. patent application No. 09/146,056, filed Sep. 2, 1998 now U.S. Pat. No. 6,106,351.

TECHNICAL FIELD

The present invention relates to microelectronic substrate assemblies, and methods for manufacturing such microelectronic substrate assemblies for use in mechanical and chemical-mechanical planarizing processes related to fabricating microelectronic devices.

BACKGROUND OF THE INVENTION

Mechanical and chemical-mechanical planarizing processes (collectively "CMP") are used in the manufacturing of microelectronic devices for forming a flat surface on semiconductor wafers, field emission displays (FEDs) and many other types of microelectronic substrate assemblies. FIG. 1 schematically illustrates a planarizing machine 10 with a platen 20, a carrier assembly 30, a polishing pad 40, and a planarizing fluid 44 on the polishing pad 40. The planarizing machine 10 may also have an under-pad 25 attached to an upper surface 22 of the platen 20 for supporting the polishing pad 40. In many planarizing machines, a drive assembly 26 rotates (arrow A) and/or reciprocates (arrow B) the platen 20 to move the polishing pad 40 during planarization.

The carrier assembly 30 controls and protects a substrate 12 during planarization. The carrier assembly 30 typically has a substrate holder 32 with a pad 34 that holds the substrate 12 via suction, and a drive assembly 36 of the carrier assembly 30 typically rotates and/or translates the substrate holder 32 (arrows C and D, respectively). The substrate holder 32, however, may be a weighted, free-floating disk (not shown) that slides over the polishing pad 40.

The combination of the polishing pad 40 and the planarizing fluid 44 generally define a planarizing medium that mechanically and/or chemically-mechanically removes material from the surface of the substrate 12. The polishing pad 40 may be a conventional polishing pad composed of a polymeric material (e.g., polyurethane) without abrasive particles, or it may be an abrasive polishing pad with abrasive particles fixedly bonded to a suspension material. In a typical application, the planarizing fluid 44 may be a CMP slurry with abrasive particles and chemicals for use with a conventional nonabrasive polishing pad. In other applications, the planarizing fluid 44 may be a chemical solution without abrasive particles for use with an abrasive polishing pad.

To planarize the substrate 12 with the planarizing machine 10, the carrier assembly 30 presses the substrate 12 against a planarizing surface 42 of the polishing pad 40 in the presence of the planarizing fluid 44. The platen 20 and/or the substrate holder 32 then move relative to one another to translate the substrate 12 across the planarizing surface 42. As a result, the abrasive particles and/or the chemicals in the planarizing medium remove material from the surface of the substrate 12.

CMP processing is particularly useful in fabricating FEDs, which are one type of flat panel display in use or proposed for use in computers, television sets, camcorder viewfinders, and a variety of other applications. FEDs have a baseplate with a generally planar emitter substrate juxtaposed to a faceplate. FIG. 2 illustrates a portion of a conventional FED baseplate 120 with a glass substrate 122, an emitter layer 130, and a number of emitters 132 formed on the emitter layer 130. An insulator layer 140 made from a dielectric material is disposed on the emitter layer 130, and an extraction grid 150 made from polysilicon or a metal is disposed on the insulator layer 140. A number of cavities 142 extend through the insulator layer 140, and a number of holes 152 extend through the extraction grid 150. The cavities 142 and the holes 152 are aligned with the emitters 132 to open the emitters 132 to the faceplate (not shown).

Referring to FIGS. 2 and 3, the emitters 132 are grouped into discrete emitter sets 133 in which the bases of the emitters 132 in each set are commonly connected. As shown in FIG. 3, for example, the emitter sets 133 are configured into rows (e.g., $R_1$–$R_3$) in which the individual emitter sets 133 in each row are commonly connected by a high-speed interconnect 170. Additionally, each emitter set 133 is proximate to a grid structure superjacent to the emitters that is configured into columns (e.g., $C_1$–$C_2$) in which the individual grid structures are commonly connected in each column by another high-speed interconnect 160. The interconnects 160 are generally formed on top of the extraction grid 150. It will be appreciated that the column and row assignments were chosen for illustrative purposes.

In operation, a specific emitter set is selectively activated by producing a voltage differential between the extraction grid and the specific emitter set. A voltage differential may be selectively established between the extraction grid and a specific emitter set through corresponding drive circuitry that generates row and column signals to intersect at the location of the specific emitter set. Referring to FIG. 3, for example, a row signal along row $R_2$ of the extraction grid 150 and a column signal along a column $C_1$ of emitter sets 133 activates the emitter set at the intersection of row $R_2$ and column $C_1$. The voltage differential between the extraction grid and the selectively activated emitter sets produces localized electric fields that extract electrons from the emitters in the activated emitter sets.

The display screen of the faceplate (not shown) is coated with a substantially transparent conductive material to form an anode, and the anode is coated with a cathodoluminescent layer. The anode, which is typically biased to approximately 1.0–5.0 kV, draws the extracted electrons across a vacuum gap (not shown) between the extraction grid and the cathodoluminescent layer of material. As the electrons strike the cathodoluminescent layer, light emits from the impact site and travels through the anode and the glass panel of the display screen. The emitted light from each of the areas becomes all or part of a picture element.

One manufacturing concern with FEDs is that the layers of materials from which the interconnects and/or the extraction grid are formed are subject to cracking or de-laminating during CMP processing. In a typical process for fabricating the baseplate 120 shown in FIG. 2, a number of conformal layers are initially deposited over the emitters 132, and then the substrate assembly is planarized. For example, a conformal dielectric layer is initially deposited over the emitter layer 130 and the emitters 132 to provide material for the insulator layer 140. A conformal polysilicon layer is then deposited on the insulator layer 140 to provide material for the extraction grid 150, and a conformal metal layer is deposited over the grid layer to provide material for the interconnects 160. After all of the conformal layers are deposited, the baseplate sub-assembly is planarized by CMP processing to form a planar surface at an elevation just above the tips of the emitters 132. CMP processing, however. applies sheer forces to the substrate that often cause the metal interconnect layer to crack or de-laminate. Moreover, if the metal interconnect layer delaminates, it may also pull up a polysilicon extraction grid layer or even the silicon dioxide insulator layer because metals generally from very strong bonds with polysilicon. Thus, CMP processing may severely damage or even destroy microelectronic substrate assemblies for FED baseplates.

Another manufacturing concern is that there is a significant drive for developing large FEDs that can be used in computers, televisions and other large scale applications. The de-lamination of the metal interconnect layer during CMP processing, however, is particularly problematic for large FED applications because the surface area of larger substrate assemblies exacerbates the effects of the shear focus between the substrate assemblies and the polishing pads. Thus, CMP processing of FED baseplates is currently impeding progress in cost-effectively manufacturing large FEDs for consumer applications.

SUMMARY OF THE INVENTION

The present invention is directed toward microelectronic substrate assemblies, and methods for making such substrate assemblies for use in mechanical and chemical-mechanical planarizing processes. A microelectronic substrate assembly is fabricated in accordance with one aspect of the invention by forming a critical layer in a film stack on the substrate and manipulating the critical layer to have a low compression internal stress. The critical layer, more specifically, is a layer that is otherwise in a tensile state or a high compression state without being manipulated to control the internal stress in the critical layer to be in a low compression state. The critical laver can be manipulated by changing the chemistry, temperature or energy level of the process used to deposit or otherwise form the critical layer. A critical layer composed of chromium, for example, can be manipulated by sputtering chromium in an argon/nitrogen atmosphere instead of solely an argon atmosphere to impart stress controlling elements (nitrogen) into the chromium for producing a low compression chromium layer. Alternatively, the critical layer can be manipulated by heat treating or doping the critical layer to change the internal stress from a tensile or high compression state to a low compression state.

One aspect of the invention is the discovery that layers of a film stack in a low compression state generally do not crack or delaminate during CMP processing. Another aspect of the invention is the discovery that tensile layers or highly compressive layers are critical layers that often fail during CMP processing. Thus, based on these discoveries, the stress of tensile or highly compressive critical layers in a film stack is manipulated or otherwise controlled to impart a low compression state to such critical layers in accordance with still another aspect of the invention.

DETAILED DESCRIPTION OF THE INVENTION

The present invention is directed toward film stack structures on microelectronic substrate assemblies, and methods for manufacturing such microelectronic substrate assemblies for use in mechanical and/or chemical-mechanical planarizing processes. Many specific details of certain embodiments of the invention are set forth in the following description and in FIGS. 4–5B to provide a thorough understanding of such embodiments. One skilled in the art, however, will understand that the present invention may have additional embodiments, or that the invention may be practiced without several of the details described in the following description. For example, even though the invention is applicable to fabricating microelectronic substrate assemblies for virtually any type or microelectronic device subject to CMP processing, many aspects of the invention are particularly useful for fabricating FED baseplates. Thus, without limiting the scope of the invention, several embodiments of the invention will be disclosed with respect to fabricating FED baseplates.

Figure 1:
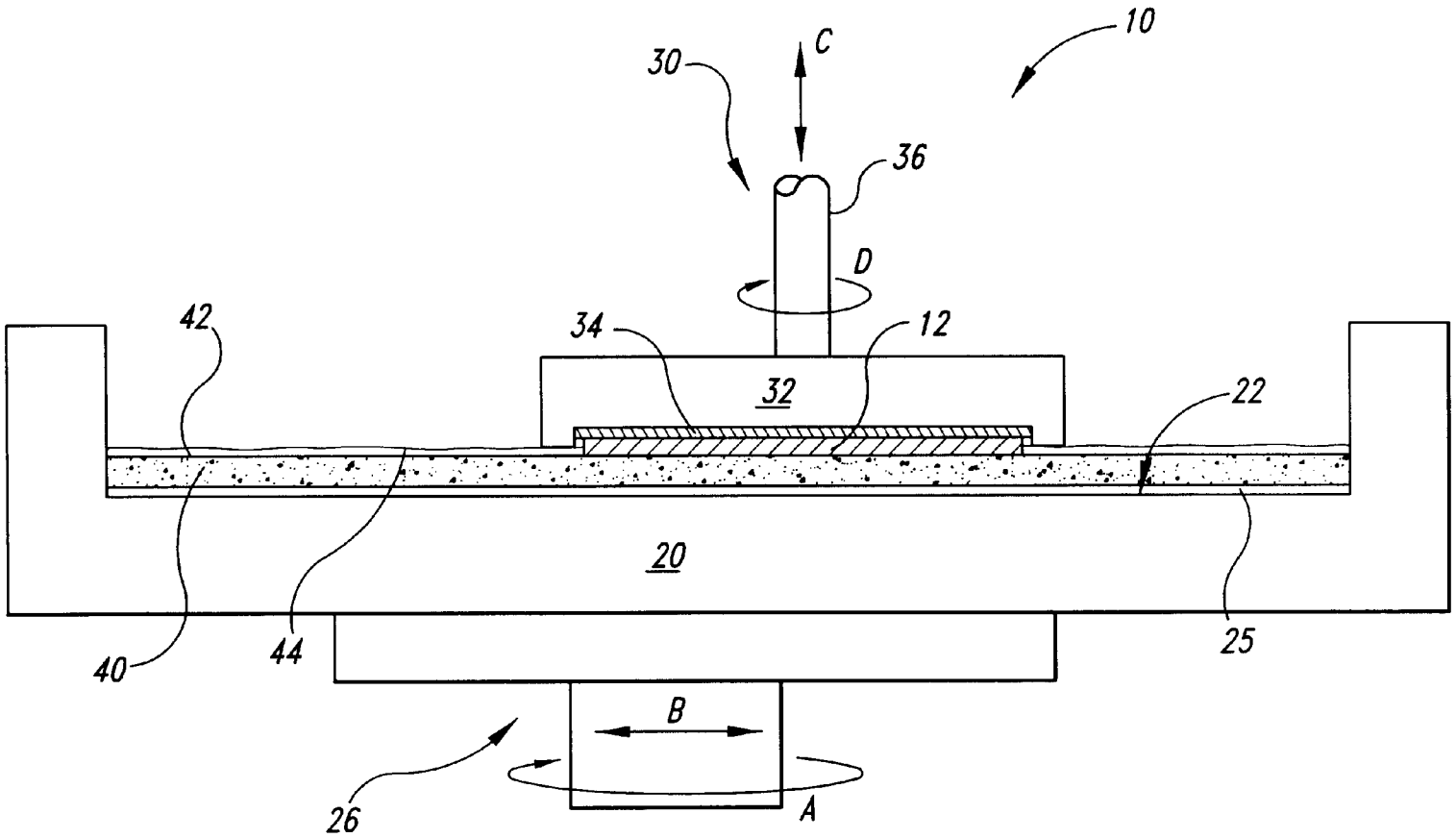
Fig. 1 (Prior Art)
FIG. 1 is a schematic view of a planarizing machine for chemical-mechanical planarization of substrates in accordance with the prior art.
Figure 2:
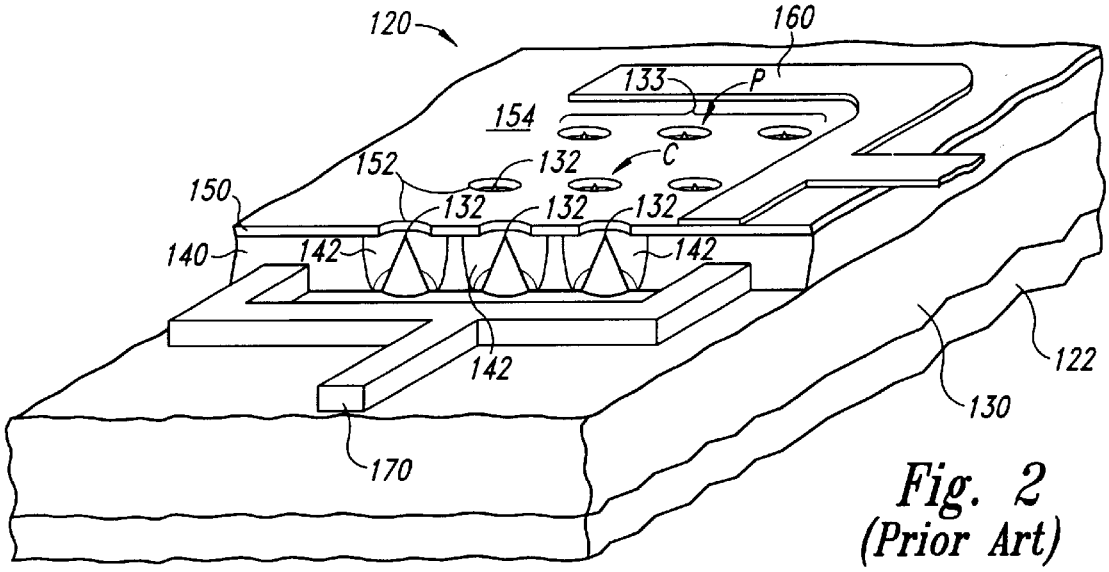
Fig. 2 (Prior Art)
FIG. 2 is a partial isometric view of a field emission display in accordance with the prior art.
Figure 3:
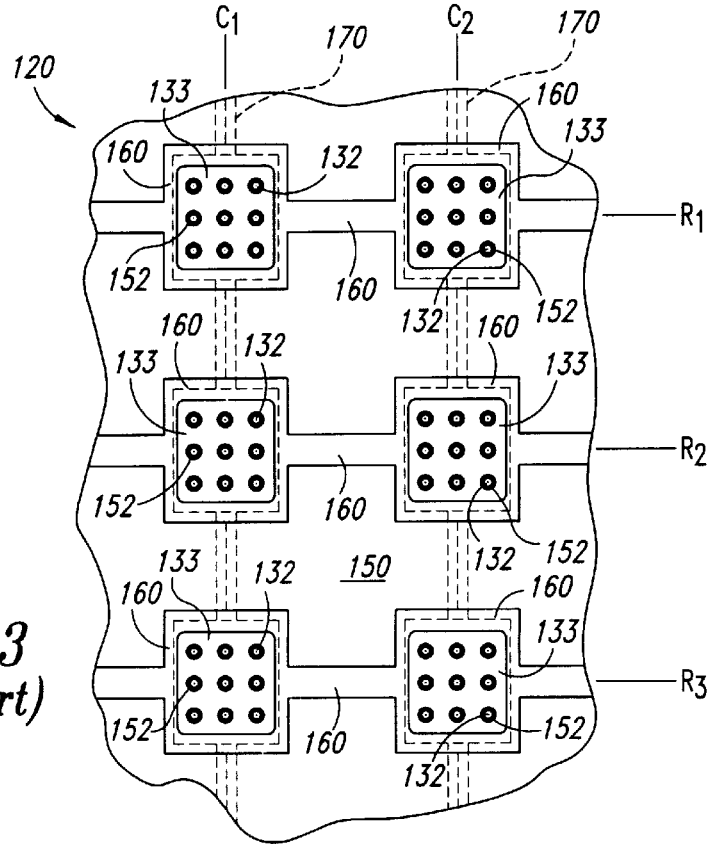
Fig. 3 (Prior Art)
FIG. 3 is a schematic top plan view of the field emission display of FIG. 2.
Figure 4:
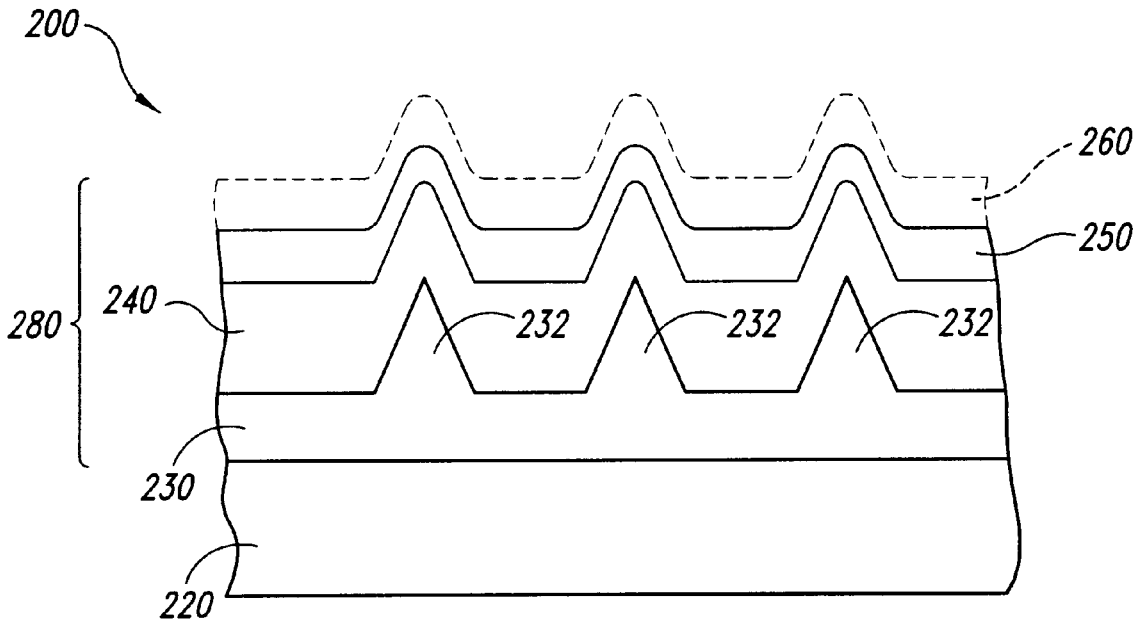
FIG. 4 is a schematic cross-sectional view of a microelectronic substrate assembly at one point in a process in accordance with one embodiment of the invention.

FIG. 4 is a schematic cross-sectional view illustrating an initial stage of a method for fabricating an FED baseplate 200 in accordance with one embodiment of the invention. At this particular stage, the baseplate 200 has a glass substrate 220, an emitter layer 230 on the glass substrate 220, and a plurality of emitters 232 either formed on the emitter layer 230 or formed from the emitter layer 230. The emitter layer 230 is typically made from conductive silicon or another semiconductive or conductive material. As described above, the emitters 232 are preferably grouped into rows and columns of discrete emitter sets. The emitters 232 are preferably conical-shaped protuberances that project upwardly from the emitter layer 230 toward a face plate (not shown). The shape of the emitters 232, however, may be any other suitable shape.

After the emitters 232 are formed on the emitter layer 230, an insulator layer 40 is formed over the emitter layer 230. The insulator layer 240 may be composed of silicon dioxide, borophosphate silicon glass (BPSG), phosphate silicon glass (PSG), or any other suitable dielectric or at least substantially dielectric material. The insulator layer 240 is also preferably a conformal layer that closely conforms to the contour of the emitters 232 and other topographical features of the emitter layer 230.

After the insulator layer 240 is formed, a grid layer 250 is formed over the insulator layer 240. Suitable materials for the grid layer 250 include chromium, molybdenum, aluminum, copper, tungsten, polysilicon or any other suitable conductive or semiconductive material. The grid layer 250 is preferably deposited to a thickness of 0.5 $\mu$m to 5.0 $\mu$m. As with the insulator layer 250, the grid layer 250 is also a conformal layer that closely conforms to the contour of the insulator layer 240. In some applications, a conformal interconnect layer 260 (shown in phantom) is subsequently formed on the grid layer 250. The interconnect layer 260 is generally composed of a metal, such as aluminum, copper, chromium, molybdenum, tungsten or other highly conductive metals.

The emitter layer 230, insulator layer 240, grid layer 250, and interconnect layer 260 form a film stack 280 on the glass substrate 220. In accordance with an aspect of fabricating the baseplate 200, the stress in each layer of the film stack 280 is controlled or otherwise manipulated such that all of the layers in the film stack 280 are in a low compression state. Suitable compressive states for layers in the film stack 280 are between 0 and $7\times10^8$ dynes/cm$^2$, and more preferably from approximately $2\times10^8$ to approximately $6\times10^8$ dynes/cm$^2$, and even more preferably from approximately $4\times10^8$ to approximately $5\times10^8$ dynes/cm$^2$.

A few particular examples of controlling the stress in the film stack 280 are the formation of a chromium grid layer 250 over the insulator layer 240, or the formation of a chromium interconnect layer 260 over a polysilicon grid layer 250. In a conventional FED baseplate, a conventional chromium layer is typically formed using a 2 kW DC sputter in an argon only plasma at approximately 90 sccm$^2$. Such conventional chromium layers are in a tensile state of approximately $+1\times10^9$ dynes/cm$^2$ to $+1\times10^{10}$ dynes/cm$^2$. In contrast to conventional chromium layers, the chromium grid layer 250 is formed by depositing chromium onto the insulator layer 240 with a 2 kW DC sputter in an argon/nitrogen plasma at 90 sccm$^2$. Similarly, the chromium interconnect layer 260 can be formed by depositing chromium onto a polysilicon grid layer 250 with a 2 kW DC sputter in an argon/nitrogen plasma at 90 sccm$^2$. The argon/nitrogen plasma can be approximately 65% argon and 35% nitrogen. Such a chromium grid layer 250 or a chromium interconnect layer 260 has a low compressive state of approximately $5\times10^8$ dynes/cm$^2$. The difference between the chromium grid or interconnect layers 250, 260 of the invention and conventional chromium layers is that the nitrogen imparted to the grid layer significantly changes the type of stress in the layers 250, 260. The nitrogen is accordingly a stress control component or element that imparts a low compressive stress to the chromium grid or interconnect layers 250, 260. Thus, one particular aspect of the invention is to manipulate the stress during formation of a critical layer by imparting stress control elements that create a low compression state in the layer.

Figure 5A:
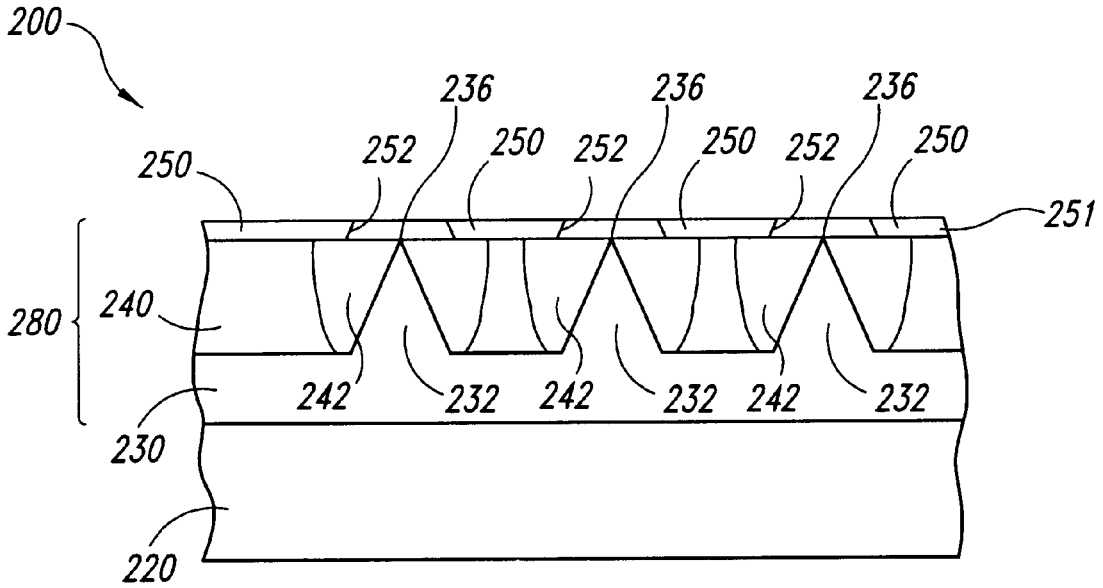
FIG. 5A is a schematic cross-sectional view of the microelectronic substrate of FIG. 4 at a subsequent point in the process.
Figure 5B:
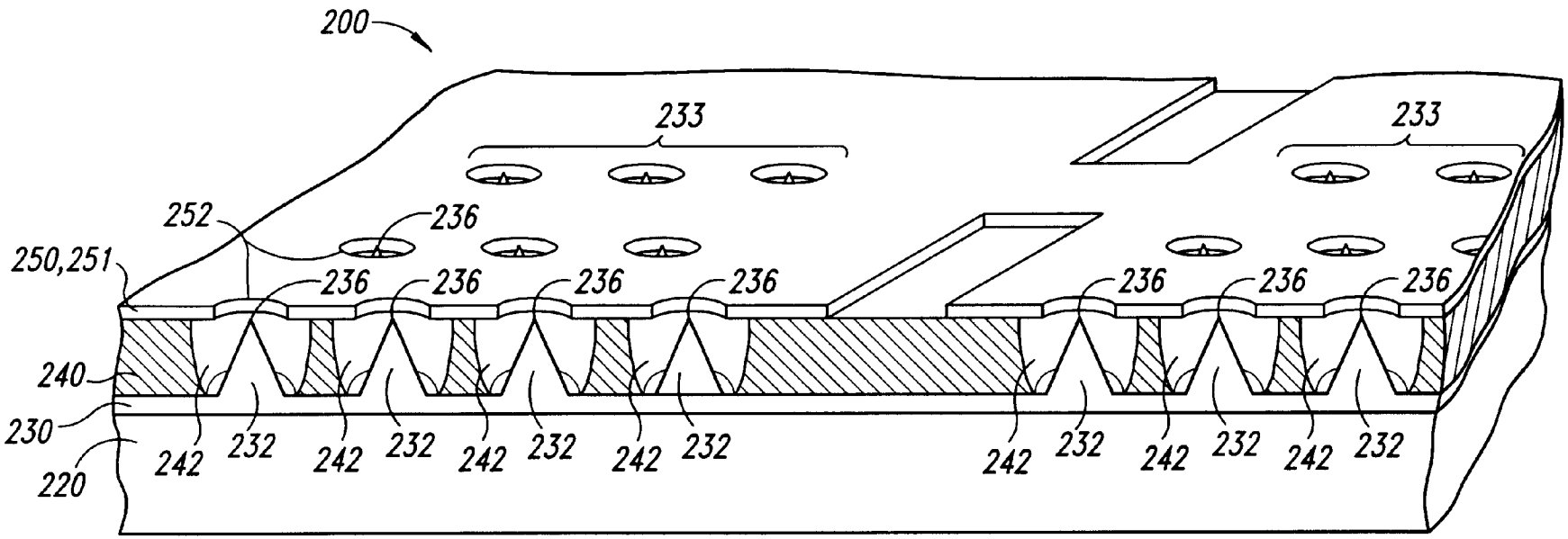
FIG. 5B is a schematic isometric view of the microelectronic substrate of FIG. 5A.

FIG. 5A is a schematic cross-sectional view and FIG. 5B is a schematic isometric view that illustrate the baseplate 200 after the grid layer 250 and the insulator layer 240 have been planarized with a CMP process and etched to form an extraction grid 251. To planarize the baseplate 200 with a CMP process, the baseplate 200 is inverted and pressed against a chemical-mechanical planarization polishing pad in the presence of a planarizing solution under controlled chemical pressure, velocity, and temperature conditions. The planarizing solution is generally a slurry containing small, abrasive particles that abrade the front face of the baseplate, and chemicals that etch and/or oxidize the materials of the grid layer 250 and the insulator layer 240. The polishing pad is generally a planar pad made from a continuous phase matrix material, and abrasive particles may be bonded to the matrix material. Thus, when the pad and/or the baseplate move with respect to one another, material is removed from the front face of the baseplate by the abrasive particles (mechanical removal), and by the etching and/or oxidizing effect of the planarizing solution (chemical removal).

The CMP process produces a number of holes or openings 252 in the grid layer 250 over the emitters 232. At the endpoint of the CMP process, for example, a sufficient amount of material is removed from the grid layer 250 and the insulator layer 240 to form the openings 252 in the grid layer 250 without exposing the emitters 232. The openings 252 in the grid layer 250 are accordingly filled with the insulator layer 240 immediately after the CMP process.

To expose the emitters 232, the portions of the insulator layer 240 in the openings 252 and proximate to the openings 252 under the grid layer 250 are removed to form a plurality of cavities 242 in the insulator layer 240. The cavities 242 are preferably formed by a selective wet etching process that etches the insulator layer 240 without removing a significant amount of material from either the grid layer 250 or the emitters 232. Each cavity 242 is accordingly adjacent to an emitter 232 to open the emitters 232 to the extraction grid 251 and the faceplate (not shown). At this point, the baseplate 200 is substantially complete.

One aspect of forming the film stack 280 with low compressive layers is that the layers in the film stack 280 generally do not crack or de-laminate during CMP processing. As set forth above, two features of the invention are the discoveries that low compression layers generally do not crack or de-laminate during CMP processing, and that tensile layers and/or highly compressive layers are often critical layers that fail during planarization against a polishing pad in the presence of abrasive particles. Based upon these discoveries, it was found that controlling or otherwise manipulating the internal stress in such critical layers to be in a low compression state can reduce cracking and de-lamination of layers in a film stack during CMP processing.

Several advantages of forming film stacks with low compressive layers are further understood in light of the particular application of forming chromium grid or interconnect layers in FED baseplates. In general Fabricating large FED baseplates is particularly problematic because they require large glass substrates that must be processed with low temperature processes (e.g., <500° C.) to maintain the properties of the glass. Conventional tensile chromium layers fabricated without stress controlling components often de-laminate from underlying layers when the baseplates are planarized using CMP processing to form the extraction grid. Conventional tensile chromium layers, in fact, may even pull-up portions of the insulator layer because chromium bonds very well with typical dielectric materials for the insulator layers. Such tensile chromium layers are accordingly critical layers that are generally subject to failing during CMP processing. In accordance with at least one embodiment of the invention however, the stress is controlled in a chromium layer by imparting stress control components (e.g., nitrogen) during the formation of the chromium layer to form a low compression chromium layer. During CMP, such low compression chromium layers generally do not crack or de-laminate from the substrate assembly. Accordingly, forming a film stack with low compression layers is particularly useful in fabricating FED baseplates because tensile grid or interconnect layers are subject to failing during CMP.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. A baseplate for a field emission display, comprising:

a substrate;

a plurality of emitters on the substrate;

an insulator layer over the substrate and adjacent to the emitters, the insulator layer having a plurality of apertures aligned with the emitters, and the insulator layer being in a low compression state; and an extraction grid having a conductive layer with a plurality of openings aligned with the emitters and the apertures of the insulator layer, and the extraction grid having a plurality of metal address lines proximate to the apertures in the conductive layer, the extraction grid and the metal address lines being in a low compression state.

2. A microelectronic substrate assembly for planarization against a planarizing medium on a polishing pad, comprising:

a substrate; and a Film stack on the substrate, the film stack having a critical layer including a stress controlling component to impart a low compression stress to the critical layer, the critical layer being in a tensile state or a highly compressive state without the stress controlling component.

3. The microelectronic substrate assembly of claim 2 wherein the critical layer comprises a metal and the stress controlling component comprises nitrogen imparted to the metal in an argon and nitrogen plasma during a sputtering process.

4. The microelectronic substrate assembly of claim 3 wherein the metal comprises chromium.

5. A microelectronic substrate assembly for planarization against a planarizing medium on a polishing pad, comprising a substrate;

a critical layer supported by the substrate, the critical layer being composed of a material subject to having a tensile state or a highly compressive state on the substrate; and a stress controlling element in the critical layer that controls internal stress within the critical layer to impart a low compressive stress to the critical layer.

6. The microelectronic substrate assembly of claim 5 wherein the critical layer comprises a metal and the stress controlling component comprises nitrogen imparted to the metal in an argon and nitrogen plasma during a sputtering process.

7. The microelectronic substrate assembly of claim 6 wherein the metal comprises chromium.

* * * * *

UNITED STATES PATENT AND TRADEMARK OFFICE

CERTIFICATE OF CORRECTION

PATENT NO. : 6,239,548 B1
DATED : May 29, 2001
INVENTOR(S) : Kanwal K. Raina and James J. Alwan It is certified that error appears in the above-identified patent and that said Letters Patent is hereby corrected as shown below:

Title page,
Item [54], reads "MICROELECTRONIC SUBSTRATE ASSEMBLIES HAVING ELEMENTS IN LOW COMPRESSION STATE" and should read
-- MICROELECTRONIC SUBSTRATE ASSEMBLIES AND METHODS OF MANUFACTURING SUCH MICROELECTRONIC SUBSTRATE ASSEMBLIES FOR USE IN MECHANICAL AND CHEMICAL-MECHANICAL PLANARIZATION PROCESSES --

Signed and Sealed this

Twenty-sixth Day of February, 2002

*Attest:*

*Attesting Officer*

JAMES E. ROGAN
*Director of the United States Patent and Trademark Office*